US007198200B2

(12) United States Patent
Kowalski

(10) Patent No.: US 7,198,200 B2
(45) **Date of Patent: *Apr. 3, 2007**

(54) BIBLOCK OR MULTIBLOCK TRANSVERSE MEMBER AND METHOD FOR THE PRODUCTION THEREOF

(75) Inventor: Martin Kowalski, Nuremberg (DE)

(73) Assignee: Pfleiderer Infrastrukturtechnik GmbH & Co. KG, Neumarkt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/501,971

(22) PCT Filed: Jul. 9, 2003

(86) PCT No.: PCT/EP03/07369

§ 371 (c)(1),
(2), (4) Date: Jul. 20, 2004

(87) PCT Pub. No.: WO2004/005618

PCT Pub. Date: Jan. 15, 2004

(65) Prior Publication Data

US 2005/0145709 A1 Jul. 7, 2005

(30) Foreign Application Priority Data

Jul. 9, 2002 (DE) ..... 102 30 741

(51) Int. Cl.
*E01B 5/00* (2006.01)

(52) U.S. Cl. ..... 238/115; 238/117

(58) Field of Classification Search ..... 238/50, 238/51, 52, 53, 85, 86, 115, 116, 117, 40, 238/41, 80, 91, 94
See application file for complete search history.

(56) References Cited

U.S. PATENT DOCUMENTS

| | | | | | |
|---|---|---|---|---|---|
| 605,866 | A | * | 6/1898 | Graham | 238/52 |
| 767,240 | A | * | 8/1904 | Quimby | 238/89 |
| 978,343 | A | * | 12/1910 | Wills | 238/115 |
| 990,650 | A | * | 4/1911 | Hayes | 238/117 |
| 1,008,829 | A | * | 11/1911 | Killinger | 238/31 |
| 3,190,607 | A | * | 6/1965 | Sonneville | 238/115 |
| 3,371,866 | A | * | 3/1968 | Sonneville | 238/58 |
| 3,574,898 | A | * | 4/1971 | Scott et al. | 24/32 |
| 4,651,924 | A | * | 3/1987 | Javelle | 238/117 |
| 5,285,964 | A | * | 2/1994 | Vanotti | 238/7 |
| 6,488,215 | B2 | * | 12/2002 | Mohr | 238/2 |

FOREIGN PATENT DOCUMENTS

| | | |
|---|---|---|
| BE | 466 934 | 8/1946 |
| EP | 0 552 788 | 7/1993 |
| EP | 1 026 320 | 8/2000 |
| GB | 240 757 | 10/1925 |

* cited by examiner

*Primary Examiner*—Mark T. Le
(74) *Attorney, Agent, or Firm*—Jordan and Hamburg LLP

(57) ABSTRACT

A biblock or multiblock transverse member is provided with concrete blocks which includes plates connected to each other with the aid of an incorporated reinforcement elements. The transverse member consists of many individual prefabricated blocks whose two reinforcement elements are interconnected, more particularly welded.

8 Claims, 3 Drawing Sheets

BIBLOCK OR MULTIBLOCK TRANSVERSE MEMBER AND METHOD FOR THE PRODUCTION THEREOF

BACKGROUND OF THE INVENTION

The invention relates to a two-block or multi-block railroad tie with concrete blocks, which carry the rail supports and are connected with one another by tied-in reinforcing parts, as well as to a method for producing such two-block or multi-block railroad ties.

For previous methods of producing two-block railroad ties or also multi-block railroad ties, complete ties are produced in one mold and subsequently have to be equipped only with the rail-fastening means. This method of producing the complete ties, and this applies, of course, particularly to multi-block railroad ties, such as those used, for example, at the switch points, has the disadvantage that the very long and, with that, also heavy railroad ties can be transported only awkwardly from the manufacturing plant to the far-removed building site. In so doing, the danger also exists, in particular, that the long railroad ties will be damaged during this transport and, especially, will be bent, so that they are no longer aligned accurately for the desired gauge.

SUMMARY OF THE INVENTION

It is therefore an object of the invention to configure a two-block or multi-block railroad tie of the type mentioned above, which can be produced easily and ensures a more advantageous, damage-free transport to the building site.

Pursuant to the invention, this objective is accomplished owing to the fact that the two-block or multi-block railroad tie consists of several prefabricated individual blocks, the protruding reinforcements of which are connected with one another and, in particular, welded together. This results in a preferred manufacturing method, for which the prefabricated individual blocks, which, after all, are correspondingly short and light, are transported from the factory to the building site and are aligned to the correct gauge with the help of a gage and connected with one another only in the area of the building site.

In a development of the invention, equalizing pieces are disposed between the reinforcing parts of the individual blocks in order to make possible a connection, especially a welded connection, at the correct gauge width in spite of any displacement of the alignment.

For this purpose and in accordance with a further distinguishing feature of the present invention, the protruding reinforcing parts in the individual blocks may, for example, be offset laterally in each case, so that, when the individual blocks are aligned axially, they overlap one another and extend closely adjacent to one another. This construction enables the track lengths to be equalized by a mutual displacement of the individual blocks and, at the same time, as a result of the overlapping of the reinforcing parts, to ensure that a problem-free connection in any assignment of the individual blocks, in spite of this displaceability.

It is particularly advantageous if the reinforcements are V-shaped bar joists with, in each case, three parallel, longitudinal reinforcing rods, which are connected with one another by a zigzag-shaped bracing.

For this construction as bar joists, it can very easily be arranged that the protruding sections of the bar joists are sufficiently long, so that they mutually overlap in every case. By slightly bending up the one bar joist, it can readily overlap the protruding bar joist of the adjoining individual block, whereupon the mutually overlapping parts can be clamped, bolted or preferably welded.

Moreover, a connection, for which the protruding sections of the bar joists are constructed shortened, so that they are still at a distance from one another for the final assembly, is achieved particularly easily. The connection can then be brought about by a correspondingly somewhat larger bar joist piece, which is placed simply ever the mutually opposite bar joist ends of the individual blocks and then, as already indicated, clamped together with or bolted or welded to these.

Finally, it is also within the scope of the invention that the mutually braced reinforcing parts also protrude downward from the only partly formed concreting of the individual blocks. This ensures that the railroad ties are embedded even more strongly in the pavements especially in the case of solid pavements with railroad ties embedded in the sealing layer.

As already indicated, the present invention is generally suitable for railroad ties at switch points, since these are particularly long and heavy, especially in the end regions of the switch points, where the outer rails are relatively far apart. If they are then also to be constructed as multi-block ties for the purpose of saving weight, a special transporting problem arises in view of the length, since it is very likely then that damage and bending will occur.

Further advantages, distinguishing features and details of the invention arise out of the following description of an example and from the accompanying drawings.

DESCRIPTION OF THE PREFERRED EMBODIMENTS

Figure 1:
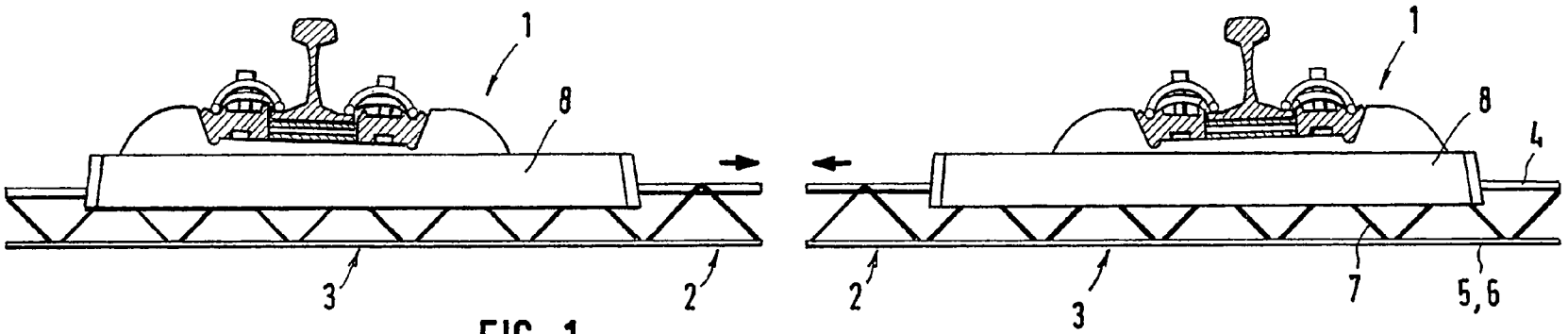
FIG. 1 shows an exploded representation of an inventive two-block railroad tie before the individual blocks are connected to one another.

FIG. 1 shows a two-block railroad tie especially for a solid pavement, with individual blocks 1 of identical construction, which are to be connected with one another and which merely are rotated by 180°, so that the reinforcing parts 2 protruding from them, after an appropriate alignment of the individual blocks, can be connected with one another with the help of a gage. For this purpose, either appropriate connecting pieces can be placed down, which are connected with the two reinforcing parts 2, or the reinforcing parts are offset laterally, so that, when the individual blocks 1 are aligned axially, being laterally offset, they overlap one another and, in this way, can be welded together. For the embodiment of individual blocks 1 shown, the reinforcement of which is formed by one or optionally also several V-shaped, angled bar joists 3, for which in each case three reinforcing rods 4, 5 and 6, which extend parallel to one another, are connected with one another by zigzag-shaped meandering coils 7, it is possible that, contrary to the embodiment shown in FIG. 1, the bar joists 3 are composed in each case of two sections of different dimensions, overlapping in the interior of the concrete blocks 8 of the individual blocks 1, in such a manner that the sections, when brought together, can grip one another. Should this not be possible by bending up the one protruding section, it is likely, as already mentioned above, that the protruding sections 2 of the bar joists 3 is constructed shortened in such a manner, that they are no longer able to contact one another at the building site during the alignment. Instead, the connection is brought about by spacers, preferably by bar joist sections inserted in them or slipped over then. These bar joist sections are clamped, bolted or preferably welded together with the ends 2.

Figure 2:
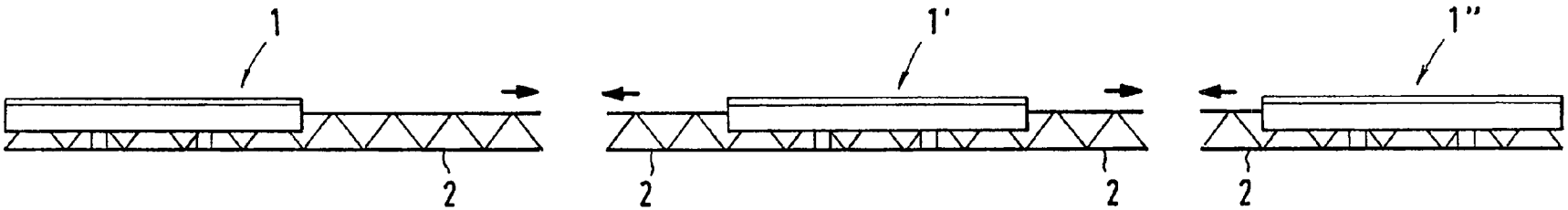
FIG. 2 shows a diagrammatic view of a multi-block railroad tie consisting of three individual blocks before these individual blocks are finally aligned and connected with one another.

A three-block railroad tie for switch points, consisting of the individual blocks 1, 1' and 1", is shown diagrammatically in FIG. 2, that is, without a detailed representation of the rail supports. In this case also, these individual blocks 1, 1' and 1" are prefabricated in the factory and transported to the building site as lightweight components of small volume and aligned there finally at the correct intervals with the help of a gage. The protruding reinforcing parts 2 are then once again connected with one another, especially by welding.

Figure 3:
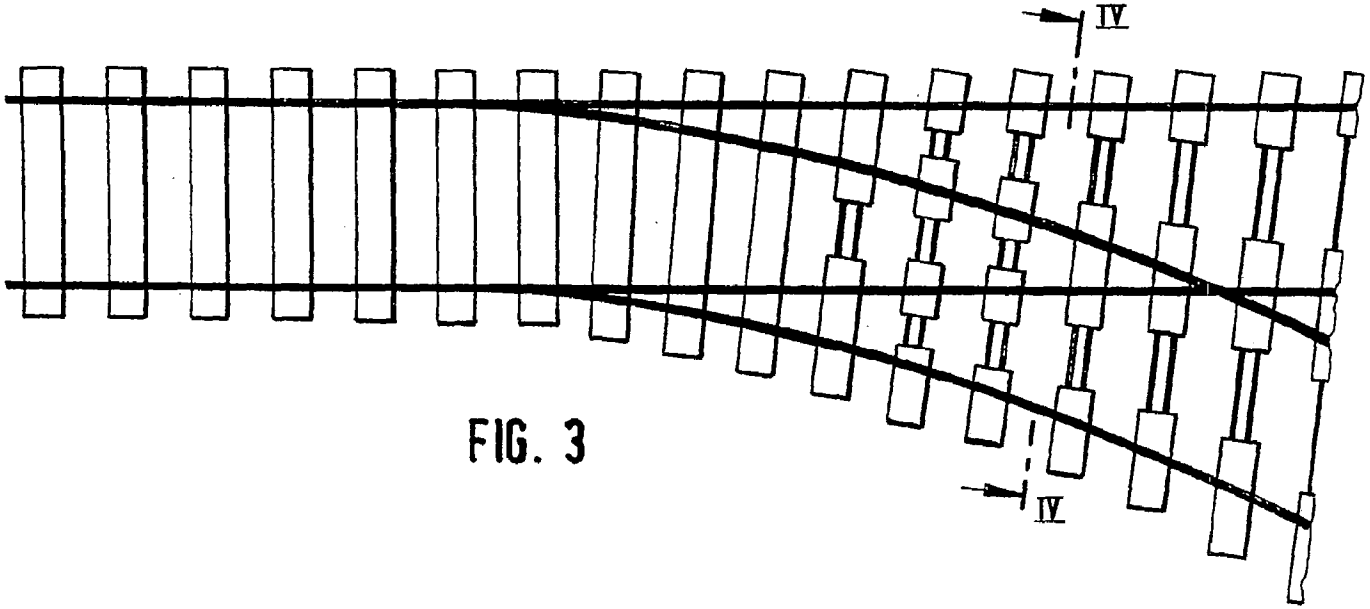
FIG. 3 shows a diagrammatic plan view of switch points to illustrate the multi-block railroad ties required there.

FIG. 3 diagrammatically shows a plan view of switching points, in the area of which there is a plurality of completely different railroad ties. In the example shown, especially in the region of the switch points itself, the railroad ties no longer are constructed as mono-block railroad ties of appropriate length. Instead, they are constructed as multi-block railroad ties. For this purpose, the inventive final assembly from prefabricated individual blocks directly at the building site is particularly suitable.

Figure 4:
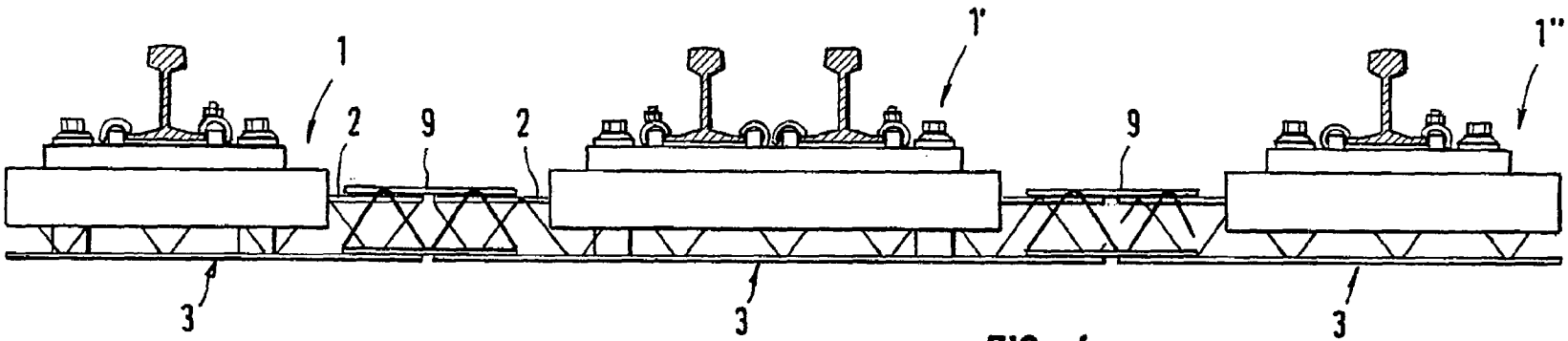
FIG. 4 shows a section along the line IV—IV in FIG. 3.

FIG. 4 shows one such three-block railroad tie as a section along line IV—IV in FIG. 3, the protruding reinforcing parts 2 of the reinforcements, which are constructed also here once again as bar joists 3, are constructed by overlapping bar joist sections 9, which end at a distance from one another. These bar joist sections 9 are clamped, bolted or preferably welded together with the bar joist end parts 2 in a manner that is not shown.

In the final analysis, it does not matter at all that, as can be seen in FIG. 3, five to six different individual blocks are required for constructing the different railroad ties at switch points since, in the example shown, at least seven or more different, very long and unwieldy railroad ties for switch points would be required for the example shown in the case of a mono-block construction. The individual blocks, which are produced more easily because shorter molds are required, and their simpler, damage-free transport and their very simple connection to the finished railroad ties for switch points immediately before the installation at the building site, make the inventive production from such individual blocks appreciably more advantageous than the conventional prefabrication in the plant of the whole railroad ties for switching points.

Figure 5:
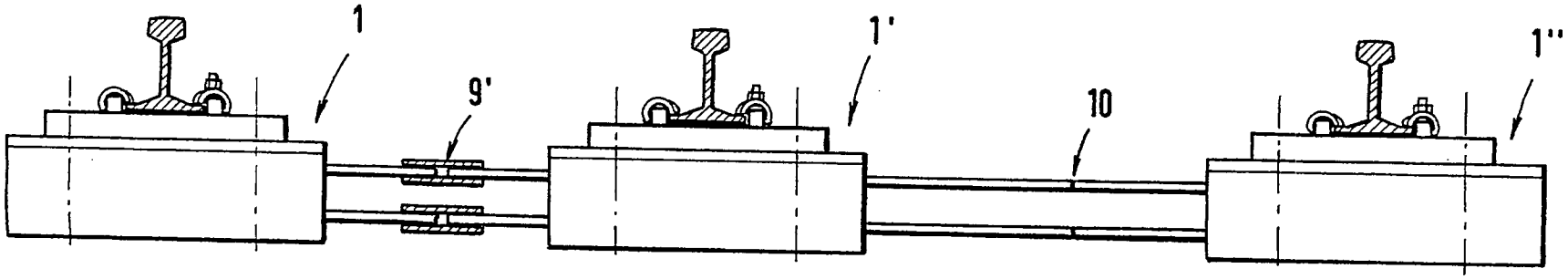
FIG. 5 shows a view of a three-block railroad tie with differently constructed reinforcement.

FIG. 5 shows a three-block railroad tie, through which parallel, continuous reinforcing iron is passed in the form of stronger reinforcing rods or pipes. Aside from butt welding, which however permits only slight equalization movements in the gage at the building site and are therefore requires particularly accurate prefabrication in the plant, the connection can be brought about particularly easily by pushed-on pipes 9, as indicated in the left half of FIG. 5. The addressed case of butt welding 10 is shown in the right half of FIG. 5.

The invention is not limited to the example shown. In particular, it is not necessary that the concreting of the individual blocks 8 be carried out only partly, so that the reinforcements also protrude partly at the bottom from the concrete blocks, as is particularly preferred for two-block or multi-block railroad ties for solid pavements. Moreover, reinforcements other than the bar joists shown, such as prefabricated reinforcing baskets or several continuous reinforcing rods or the like could, of course, also be provided.

The invention claimed is:

1. Two-block or multi-block railroad tie which carry rail supports and which are connected to one another at an installation site, comprising:

a plurality of prefabricated individual concrete blocks having longitudinally extending protruding reinforcement parts which are V-shaped, angled bar joists;

said concrete blocks being spaced from one another at a desired spacing at said installation site by a gauge;

said longitudinally extending protruding parts of longitudinally adjacent ones of said plurality of individual blocks being longitudinally aligned when said concrete blocks are spaced from one another at said desired spacing; and installation site provided welded connections that weld together said protruding reinforcement parts of longitudinally adjacent ones of said plurality of individual blocks to thereby form the two block or multiblock railroad tie in which said concrete blocks are spaced from one another at said desired spacing.

2. The two-block or multi-block railroad tie of claim 1, wherein equalizing pieces are disposed between the reinforcing parts.

3. The two-block or multi-block railroad tie of claim 1, wherein:

the protruding reinforcing parts are, in each case, offset laterally in the individual block so that when the individual blocks are spaced from one another at said desired spacing, said laterally offset protruding reinforcement parts overlap one another; and said welded connections being disposed between said overlapping protruding reinforcing parts.

4. The two-block or multi-block railroad tie of claim 1, wherein:

each of the V-shaped, angled bar joists includes three longitudinal rods forming the edges of a triangular prism; and said tie further includes two meandering coils connecting said V-shaped, angled bar joists.

5. The two-block or multi-block railroad tie of claim 4, wherein the bar joists of each individual block are connected with one another by placed-down or pushed-in bar joist sections, which are welded together.

6. The two-block or multi-block railroad tie of claim 1, wherein the reinforcing parts, braced with one another, protrude downward out of an only partly formed concreting of the individual blocks.

7. The two-block or multi-block railroad tie of claim 1, wherein reinforcing rods of the reinforcing parts, which are spaced apart opposite one another, are connected to one another by mounted pipe sections.

8. Method for producing a two-block or multi-block railroad ties which are connected to one another at an installation site, comprising:

prefabricating a plurality of individual concrete blocks having longitudinally extending protruding reinforcement parts which are V-shaped, angled bar joists;

spacing said concrete blocks from one another at a desired spacing at said installation site by a gauge;

said longitudinally extending protruding parts of longitudinally adjacent ones of said plurality of individual blocks being longitudinally aligned when said concrete blocks are spaced from one another at said desired spacing; and installation site provided connecting by welding together the protruding reinforcement parts of longitudinally adjacently aligned ones of the plural individual blocks at the installation site to thereby form said two block or multi-block railroad tie in which said concrete blocks arc spaced from one another at said desired spacing.

* * * * *